US008888669B2

(12) United States Patent
Dunegan

(10) Patent No.: US 8,888,669 B2
(45) Date of Patent: Nov. 18, 2014

(54) EXERCISE APPARATUS FOR BALANCE AND STRENGTH TRAINING

(76) Inventor: Tim Dunegan, Cardiff, CA (US)

( * ) Notice: Subject to any disclaimer, the term of this patent is extended or adjusted under 35 U.S.C. 154(b) by 408 days.

(21) Appl. No.: 13/294,046

(22) Filed: Nov. 10, 2011

(65) Prior Publication Data

US 2013/0123077 A1 May 16, 2013

(51) Int. Cl.

| | |
|---|---|
| ***A63B 22/16*** | (2006.01) |
| ***A63B 22/18*** | (2006.01) |
| ***A63B 26/00*** | (2006.01) |
| ***A63B 21/068*** | (2006.01) |
| ***A63B 21/055*** | (2006.01) |
| ***A63B 23/12*** | (2006.01) |
| ***A63B 21/04*** | (2006.01) |
| *A63B 21/00* | (2006.01) |
| *A63B 22/00* | (2006.01) |
| *A63B 23/035* | (2006.01) |
| *A63B 71/00* | (2006.01) |
| *A63B 71/02* | (2006.01) |

(52) U.S. Cl.

CPC ..... *A63B 21/0442* (2013.01); *A63B 21/00072* (2013.01); *A63B 22/16* (2013.01); *A63B 2022/0094* (2013.01); *A63B 21/1469* (2013.01); *A63B 21/1496* (2013.01); *A63B 22/18* (2013.01); *A63B 21/0004* (2013.01); *A63B 23/03525* (2013.01); *A63B 21/068* (2013.01); *A63B 23/03541* (2013.01); *A63B 2071/0072* (2013.01); *A63B 2208/0238* (2013.01); *A63B 2071/027* (2013.01); *A63B 21/0552* (2013.01); *A63B 21/1465* (2013.01); *A63B 23/1236* (2013.01); *A63B 21/1492* (2013.01); *A63B 23/1263* (2013.01)

USPC ..... 482/146; 482/123; 482/139; 482/141

(58) Field of Classification Search

CPC ..... A63B 21/1469; A63B 21/0552; A63B 26/003; A63B 22/18; A63B 22/16; A63B 2022/0033; A63B 21/00; A63B 22/14; A63B 2208/0204; A63B 69/0093; A63B 23/1236; A63B 23/08; A63B 2071/027; A63B 22/0064

USPC ..... 482/139, 141, 146, 95, 123, 132

See application file for complete search history.

(56) References Cited

U.S. PATENT DOCUMENTS

| | | | | |
|---|---|---|---|---|
| 2,253,996 | A | 8/1941 | Bechman | |
| 3,862,768 | A | 1/1975 | England | |
| 5,330,399 | A | 7/1994 | Fan | |
| 5,730,690 | A * | 3/1998 | Guidry | 482/146 |
| 5,897,474 | A | 4/1999 | Romero | |
| 6,019,712 | A * | 2/2000 | Duncan | 482/110 |
| 6,740,011 | B1 * | 5/2004 | Tsai et al. | 482/80 |

(Continued)

*Primary Examiner* — Loan H Thanh

*Assistant Examiner* — Andrew S Lo

(74) *Attorney, Agent, or Firm* — ARC IP Law, PC; Joseph J. Mayo

(57) ABSTRACT

Exercise apparatus for balance and strength training that enables a user to perform push and pull oriented exercises with the user's hands or feet against the apparatus. Includes a pivot space, for example a slot or area or area with higher or lower areas, wherein the pivot space is configured to couple with a pivot element, for example a ball, cylinder, wheel or any other type of element that may move with respect to the pivot space and exercise interface. The movable pivot element enables force and hence torque required to balance to differ on each side of the apparatus. For example, a user with an injured shoulder may desire to utilize more force to balance during a push-up with the uninjured shoulder and less force and more range of motion to balance with the injured shoulder.

16 Claims, 9 Drawing Sheets

(56) References Cited

U.S. PATENT DOCUMENTS

| | | | | |
|---|---|---|---|---|
| 6,872,175 | B2 | 3/2005 | Lin | |
| 2004/0018924 | A1* | 1/2004 | Szydlowski et al. | 482/146 |
| 2004/0023766 | A1* | 2/2004 | Slone | 482/146 |
| 2005/0148448 | A1* | 7/2005 | Mersch | 482/141 |
| 2006/0030463 | A1* | 2/2006 | Maloy et al. | 482/126 |
| 2007/0027010 | A1* | 2/2007 | Tsai | 482/146 |
| 2007/0254789 | A1* | 11/2007 | Odien | 482/146 |
| 2008/0242515 | A1* | 10/2008 | Odien | 482/34 |
| 2010/0285941 | A1* | 11/2010 | VanBuren | 482/146 |
| 2011/0143896 | A1* | 6/2011 | Senegal | 482/139 |

* cited by examiner

201b

201c 201d
203

EXERCISE APPARATUS FOR BALANCE AND STRENGTH TRAINING

BACKGROUND OF THE INVENTION

1. Field of the Invention

One or more embodiments of the invention are related to the field of exercise devices. More particularly, but not by way of limitation, one or more embodiments of the invention enable an exercise apparatus for balance and strength training for example that may include a moving pivot exercise interface that enables balanced push-up and standing oriented exercises and extensible elements that enable pull oriented exercises.

2. Description of the Related Art

Exercise devices that enable users to perform push and pull oriented exercises are known to exist. Some devices require that the user balance while exercising. Devices that require that a user balance during exercise generally cannot be configured to disable this required balance feature. In addition there are no known devices that utilize a moving pivot element as known devices are arched or utilize a fixed position roller for example in the middle of the exercise device. Hence, for a given tilt of the exercise device, force and hence torque on both sides of the exercise device remains the same. There are also no known devices that enable a moving pivot element that changes the balance point over a two-dimensional space or even three-dimensional space having vertical offsets or patterns.

U.S. Pat. Ser. No. 2,253,996 shows an arched device with a roller as per FIGS. 6-7 that allows only one type of balance exercise.

U.S. Pat. Ser. No. 3,862,768 shows a balance device with a concave pivot space that enables only one exercise and which is to large to easily transport.

U.S. Pat. Ser. No. 5,330,399 shows an arched device with a fixed pivot area that does not enable a pivot element to move in relation to the device and hence the force required on each side of the device to balance is equal. The apparatus is arched and is to large to easily transport.

U.S. Pat. Ser. No. 5,897,474 shows a fixed pivot element device that allows for only one type of balance type exercise.

U.S. Pat. Ser. No. 6,872,175 shows a balance type device with a fixed pivot element that requires a large air chamber and which is too large to easily transport.

For at least the limitations described above there is a need for an exercise apparatus for balance and strength training.

BRIEF SUMMARY OF THE INVENTION

One or more embodiments described in the specification enable an exercise apparatus for balance and strength training. Embodiments of the invention enable a user to perform push and pull oriented exercises using an exercise interface, for example an elongated board, that enables a user to engage the device with the user's hands or feet. Embodiments of the invention generally utilize a pivot space on a bottom side of the exercise interface, for example a slot or area or area with higher or lower areas, wherein the pivot space is configured to couple with a pivot element, for example a ball, cylinder, wheel or any other type of element that may move with respect to the pivot space and exercise interface. The movable pivot element enables force and hence torque required to balance to differ on each side of an embodiment of the invention. For example, a user with an injured shoulder may desire to utilize more force to balance during a push-up with the uninjured shoulder and less force and more range of motion to balance with the injured shoulder. This is not possible in known fixed pivot element devices that include a pivot point in the middle of the device that does not move in relation to the device itself.

In one or more embodiments of the invention, a slot is utilized to implement the pivot space and a ball is utilized to implement the pivot element. If the slot is configured as a fixed width line for example, to contain the ball without gaps, i.e., the arc of the ball is such that it contacts both edges of the slot while in the pivot space, then a one-dimensional pivot space is defined. Other embodiments of the invention enable not only side-to-side unequal force balancing but also forward and backward balancing in two-dimensional based embodiments of the pivot space. This occurs if there are gaps on either or both sides of the ball when the ball engages the bottom side of the exercise interface, i.e., the ball can travel in the X-axis from side-to-side along the longer axis of the exercise interface, and also in the Y-axis orthogonal to the travel of side-to-side travel. For example a rectangular area allows the ball in this embodiment to move side-to-side and between top to bottom under the exercise interface to further alter the pivot point. Furthermore, three-dimensional pivot space embodiments enable for patterns, i.e., hills and valleys in the pivot space that may for example lie in patterns. These patterns enable a user to balance through patterns while exercising to build great amounts of control while building strength. For example, a figure eight pattern, or oval or hills or valleys may be formed into and out of the two-dimensional pivot space to define any three-dimensional shape that the pivot element moves more or less easily through.

One-dimensional embodiments of the pivot space may allow the exercise interface to tilt in one axis, for example if the pivot element is a cylinder, or wheel with flat bottom. The exercise interface may also rotate in two axes, for example if the pivot element is a ball or wheel, i.e., the exercise interface may tilt side-to-side and also forward and backward with this type of pivot element. For one-dimensional embodiments of the pivot space that are configured for one axis rotation of the exercise interface, the exercise interface generally is configured to not tilt forward and backward. For one-dimensional embodiments of the pivot space that are configured for two axis rotation or when a pivot element is utilized that enables forward and backward tilt of the exercise interface, the amount of force and torque required in the forward backward direction is the same for the top and bottom of the exercise interface. In other words, in one-dimensional embodiments of the pivot space, the pivot element moves only in one axis, which provides different force and torque on each side, i.e., left and right side of the exercise interface, so that the pivot element does not move top to bottom with respect to the exercise interface. For two-dimensional embodiments of the invention, the pivot element also moves between top and bottom, which provides unequal force and torque for the top and bottom portions of the exercise interface. This makes balancing more challenging for the user. For three-dimensional reliefs in the pivot space, i.e., a pivot space that covers an area and which also have higher and lower regions that protrude to and from the exercise interface, balancing difficulty is increased further as the amount of force required to balances changes non-linearly depending on the vertical elements utilized in the pivot space.

In one or more embodiments, the pivot element may be removed from the pivot space, or may be engaged, or locked in effectively so that the pivot element always remains moveably coupled with the exercise interface. Any type of coupling may be utilized to associate the pivot element with the pivot space, for example with a plate with a slot that has a gap that is less than the diameter of the ball, or any other type of mechanism that retains the pivot element. Other embodiments of the pivot element may include anything that may move in relation to the exercise interface and pivot space including a ball, cylinder, wheel, peg with slot engaging retainer, etc., as one skilled in the art will appreciate. Use of the ball as an embodiment of the pivot element is exemplary only. Embodiments of the invention may for example enable the pivot element to be removed or disengaged from the bottom portion of the exercise interface so as to allow for non-balanced exercises or for orienting the exercise interface vertically for seated rows for example.

One or more embodiments of the invention may utilize a handle on the top portion of the exercise interface. This enables a user to grab the handle instead of utilizing flat hands, for example when performing push-ups or handstands. In one or more embodiments, the handles may engage the exercise interface in fixed locations, for example with holes that engage pegs on each end of the handle. In other embodiments, the handles may rotate freely, i.e., engage the exercise interface on one side of the handle, or may utilize handles that rotate about the center of the handle, i.e., with a flat base coupled with the handle wherein the flat base includes a peg. In other embodiments of the invention, rotating areas, for example circles with rollers or ball bearings beneath them may be utilized to provide locations on the exercise interface that rotate, for example for certain styles of push-ups that call for rotating hands during push-ups. In one or more embodiments of the invention, the rotating areas may move in one or two axes, i.e., with plates that fit into recessed slots or areas, with or without handles for example.

Embodiments of the invention may also include at least one extensible element, for example a rubber tube or spring that may include a handle on one end for a pull oriented exercise. The extensible elements may couple with holes on the top of the exercise interface, i.e., spring-loaded ports that engage a wider element on the end of the extensible element, or may couple with holes or slots in the edges of the exercise interface. Alternatively, the extensible elements may couple in any other fashion with the exercise interface. For example, embodiments of the invention may include extensible elements that have two handles and which wrap around the bottom portion of the exercise interface or through the center of the exercise interface. The exercise interface may be tilted on edge, i.e., vertically oriented, and utilized with coupled extensible elements for upright rows for example. Alternatively, embodiments of the invention may be utilized in the horizontal orientation with or without the pivot element while using the extensible element or elements.

Embodiments of the invention are also compact and may be easy carried or transported, for example in a suitcase for travel.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

An exercise apparatus for balance and strength training will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
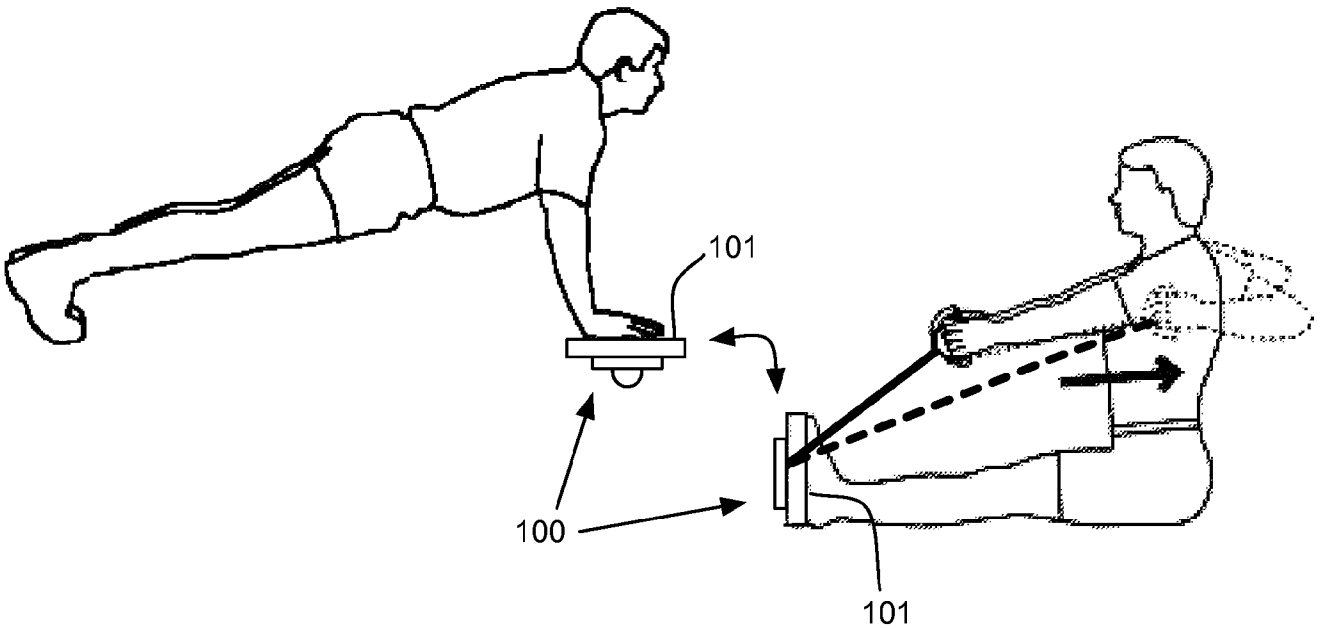
FIG. 1 illustrates a perspective view of an embodiment of the exercise apparatus for balance and strength training showing a user performing push-ups as well as performing seated rows.

FIG. 1 illustrates a perspective view of an embodiment of the exercise apparatus for balance and strength training 100 showing a user performing push-ups as well as performing seated rows. Embodiments of the invention enable a user to perform push and pull oriented exercises using exercise interface 101, for example an elongated board, that enables a user to engage the device with the user's hands or feet as shown.

Embodiments of the invention generally are implemented with a pivot space on a bottom side of the exercise interface, for example a slot or area or area with higher or lower areas, wherein the pivot space is configured to couple with a pivot element, for example a ball (as shown), cylinder, wheel or any other type of element that may move with respect to the pivot space and exercise interface. See FIGS. 2A-2D for embodiments of the pivot space.

Balanced push-ups or handstands for example may be performed with a moveable pivot element positioned under the apparatus as shown in the left portion of the figure. The movable pivot element enables force and hence torque required to balance to differ on each side of an embodiment of the invention. For example, a user with an injured shoulder may desire to utilize more force to balance during a push-up with the uninjured shoulder and less force and more range of motion to balance with the injured shoulder. This is not possible in known fixed pivot element devices that include a pivot point in the middle of the device that does not move in relation to the device itself.

Seated rows may be performed by rotating the apparatus and utilizing extensible elements as shown in the right portion of the figure. Extensible elements such as elastic cords with handles may be utilized that provide increasing force as the user pulls the handles away from the apparatus as indicated by the arrow and stretched extensible element shown as a dashed line.

Figure 2A:
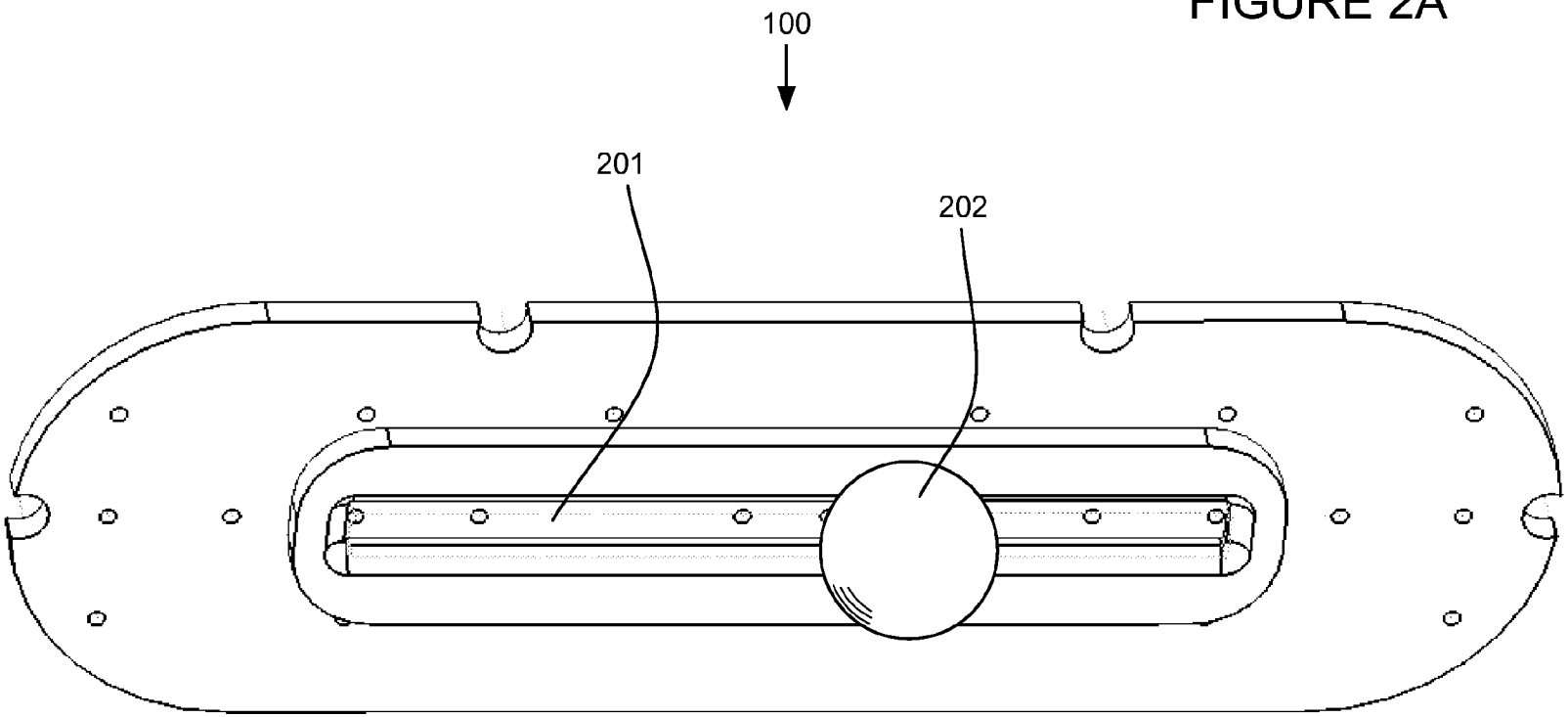
FIG. 2A illustrates a lower perspective view of an embodiment of the invention showing an embodiment of the pivot space and an embodiment of the pivot element implemented as a ball.

FIG. 2A illustrates a lower perspective view of an embodiment of the invention showing an embodiment of pivot space 201 and an embodiment of pivot element 202. In one or more embodiments of the invention, a slot is utilized to implement pivot space 201 and a ball is utilized to implement pivot element 202. If the slot is configured as a fixed width line for example, to contain the ball without gaps, i.e., the arc of the ball is such that it contacts both edges of the slot while in the pivot space, then a one-dimensional pivot space is defined.

Figures 2B, 2C, 2D:
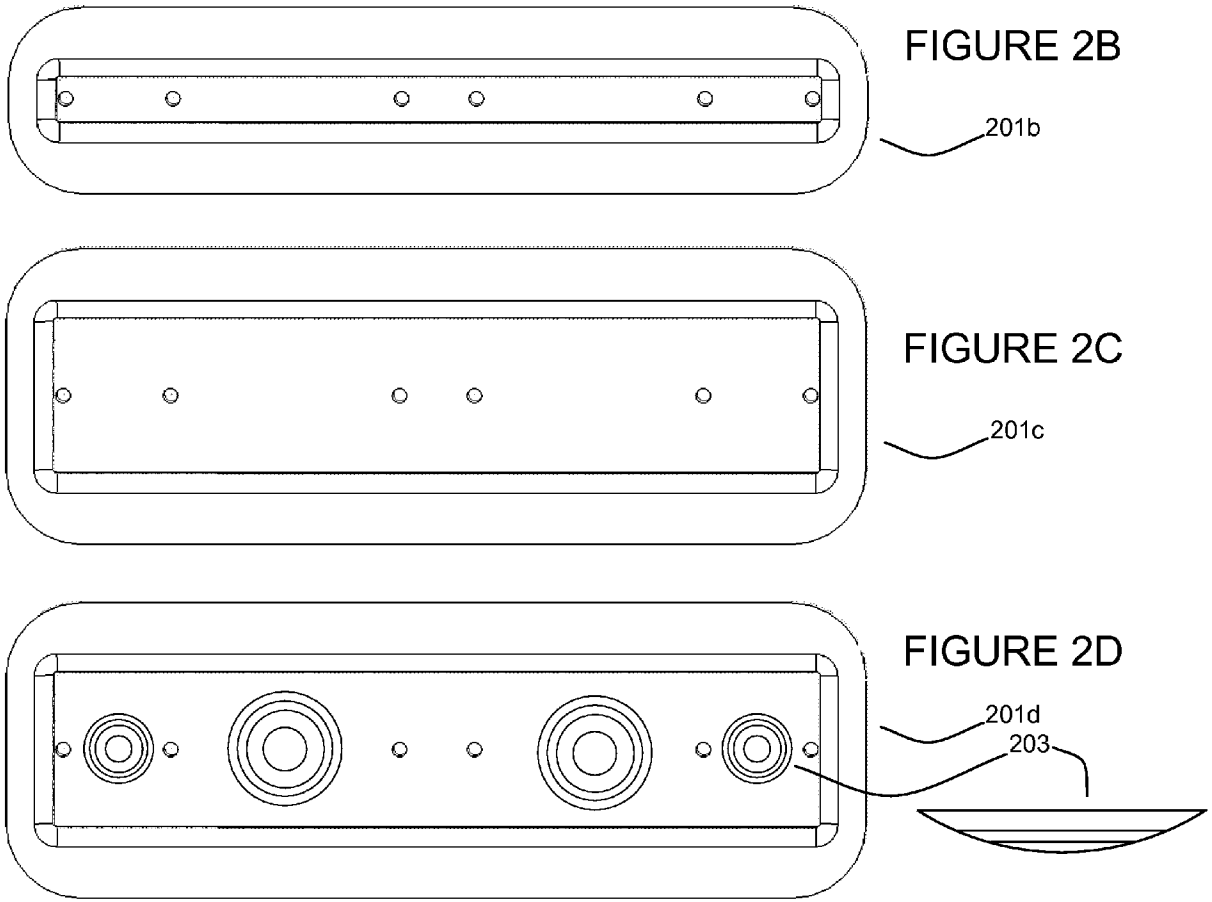
FIG. 2B illustrates another embodiment that enables not only side-to-side unequal force balancing, but also forward and backward balancing in two-dimensional based embodiments of the pivot space.
FIG. 2C illustrates another embodiment that implements a two-dimensional pivot space by utilizing a wider slot.
FIG. 2D illustrates a three-dimensional pivot space that is implemented with vertical offsets, for example hills and/or valleys in the pivot space.

FIG. 2B illustrates another embodiment that enables not only side-to-side unequal force balancing, but also forward and backward balancing in two-dimensional based embodiments of the pivot space. This occurs if there are gaps on either or both sides of the ball when the ball engages pivot space 201*b*, for example the ball can travel in the X-axis from side-to-side along the longer axis of the exercise interface, and also in the Y-axis orthogonal to the travel of side-to-side travel. In other words, a smaller ball is employed to implement two-dimensional pivot space 201*b* in this embodiment.

FIG. 2C illustrates another embodiment that implements two-dimensional pivot space 201 c by utilizing a wider slot. For example a rectangular area that allows the ball in this embodiment to move side-to-side and between top to bottom under the exercise interface to further alter the pivot point requires more effort to balance.

FIG. 2D illustrates another embodiment that implements three-dimensional pivot space 201*d* with vertical offsets 203, for example hills and/or valleys or any other shape of vertical difference in the pivot space. The vertical offsets may be toward and/or away from the exercise interface and may for example lie in patterns. These patterns enable a user to balance through patterns while exercising to build great amounts of control while building strength. For example, a figure eight pattern, or oval or hills or valleys may be formed into and out of the two-dimensional pivot space to define any three-dimensional shape that the pivot element moves more or less easily through.

One-dimensional embodiments of the pivot space may allow the exercise interface to tilt in one axis, for example if the pivot element is a cylinder, or wheel with flat bottom. The exercise interface may also rotate in two axes, for example if the pivot element is a ball or wheel, i.e., the exercise interface may tilt side-to-side and also forward and backward with this type of pivot element. For one-dimensional embodiments of the pivot space that are configured for one axis rotation of the exercise interface, the exercise interface generally is configured to not tilt forward and backward. These embodiments are not shown for brevity as one skilled in the art will recognize that if a cylinder is utilized in place of the ball as shown for exemplary purposes, that the exercise interface with not tilt forward or backward, but rather only side-to-side. For one-dimensional embodiments of the pivot space that are configured for two axis rotation or when a pivot element is utilized that enables forward and backward tilt of the exercise interface, the amount of force and torque required in the forward backward direction is the same for the top and bottom of the exercise interface. In other words, in one-dimensional embodiments of the pivot space, the pivot element moves only in one axis, which provides different force and torque on each side, i.e., left and right side of the exercise interface, so that the pivot element does not move top to bottom with respect to the exercise interface. For two-dimensional embodiments of the invention, the pivot element also moves between top and bottom, which provides unequal force and torque for the top and bottom portions of the exercise interface. This makes balancing more challenging for the user. For three-dimensional reliefs in the pivot space, i.e., a pivot space that covers an area and which also have higher and lower regions that protrude to and/or from the exercise interface, balancing difficulty is increased further as the amount of force required to balances changes non-linearly depending on the vertical elements utilized in the pivot space.

In one or more embodiments, the pivot element may be removed from the pivot space, or may be engaged, or locked in effectively so that the pivot element always remains moveably coupled with the exercise interface. Any type of coupling may be utilized to associate the pivot element with the pivot space, for example with a plate with a slot that has a gap that is less than the diameter of the ball, or any other type of mechanism that retains the pivot element. Other embodiments of the pivot element may include anything that may move in relation to the exercise interface and pivot space including a ball, cylinder, wheel, peg with slot engaging retainer, etc., as one skilled in the art will appreciate. Use of the ball as an embodiment of the pivot element is exemplary only. Embodiments of the invention may for example enable the pivot element to be removed or disengaged from the bottom portion of the exercise interface so as to allow for non-balanced exercises or for orienting the exercise interface vertically for seated rows for example.

Figure 2E:
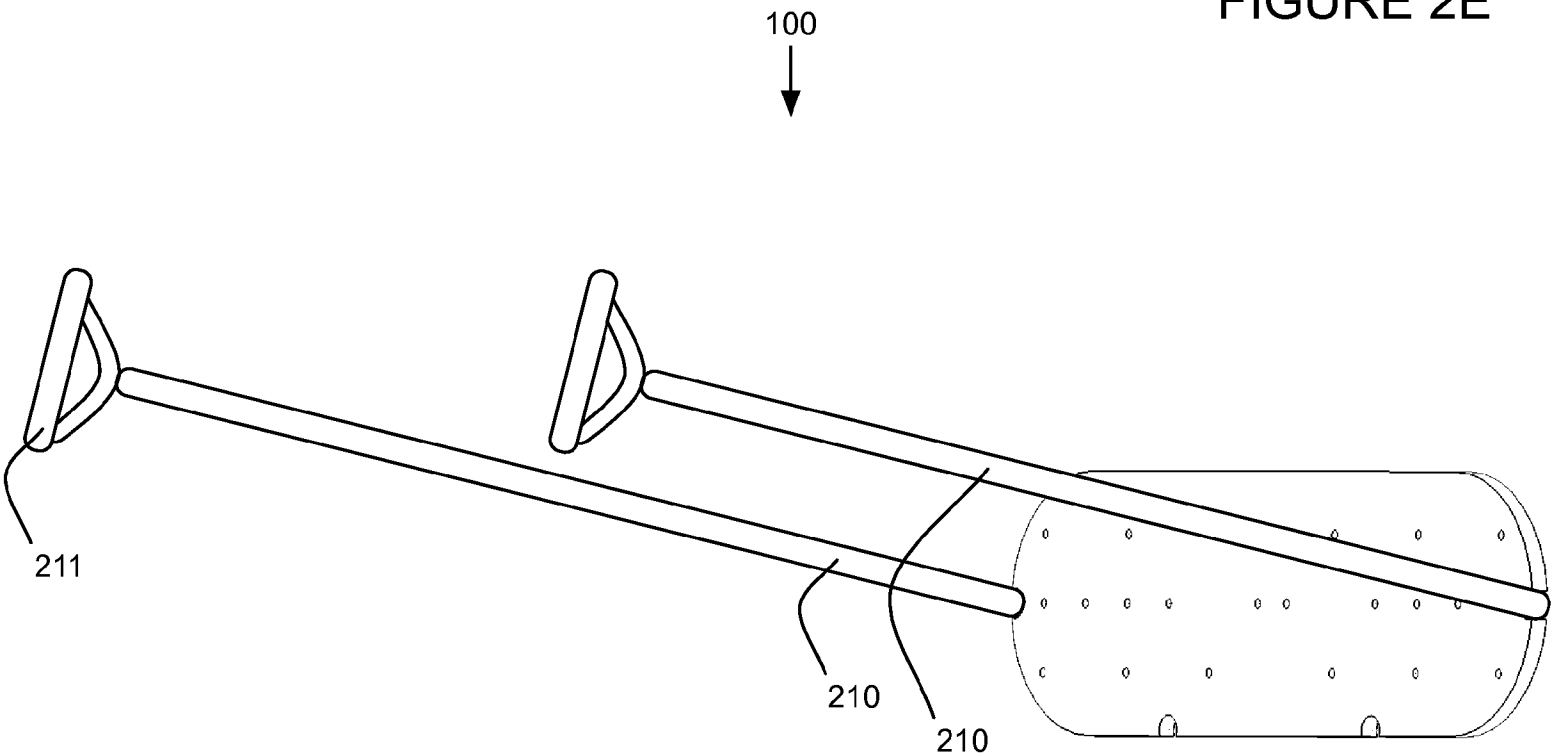
FIG. 2E illustrates a side perspective view of an embodiment of the invention with extensible elements implemented as elastic cords and with the pivot element disengaged from the pivot space.

FIG. 2E illustrates a side perspective view of an embodiment of the invention with extensible elements implemented as elastic cords and with the pivot element disengaged from the pivot space. Embodiments of the invention may also include at least one extensible element 210, for example a rubber tube or spring that may include handle 211 on one end for a pull oriented exercise. This allows for seated rows or curls. The extensible elements may couple in any manner with the top of the exercise interface, or may couple with holes or slots in the edges of the exercise interface as shown. Alternatively, the extensible elements may couple in any other fashion with the exercise interface. For example, embodiments of the invention may include extensible elements that have two handles per cord and which wrap around the bottom portion of the exercise interface or through the center of the exercise interface.

Alternatively, a user may stand on the apparatus and perform curls or upright rows, or balanced curls or upright rows as well if utilizing a pivot element for example.

Figure 3A:
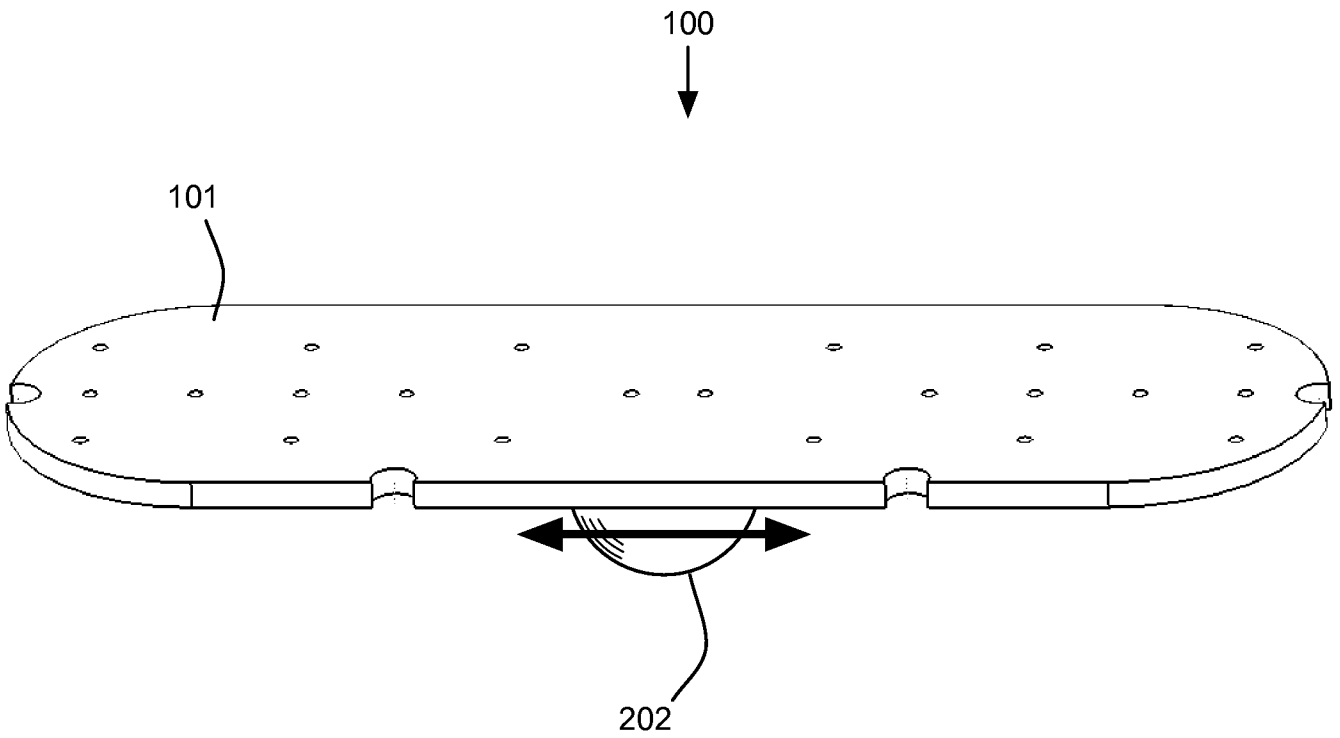
FIG. 3A illustrates a top perspective view of an embodiment of the invention without rotating elements on the top portion of the exercise interface.

FIG. 3A illustrates a top perspective view of an embodiment of the invention without rotating elements on the top portion of the exercise interface. A user may place hands or feet on each side of exercise interface 101 or even in the middle and perform exercises while pivot element 202 is free to move left and right in one dimensional embodiments as illustrated by the arrow, or in two dimensions including to/from the top and bottom of the exercise interface. In addition, for three-dimensional embodiments, pivot element 202 may vary in distance from exercise interface 101 to provide even more challenging balancing by the user.

Figure 3B:
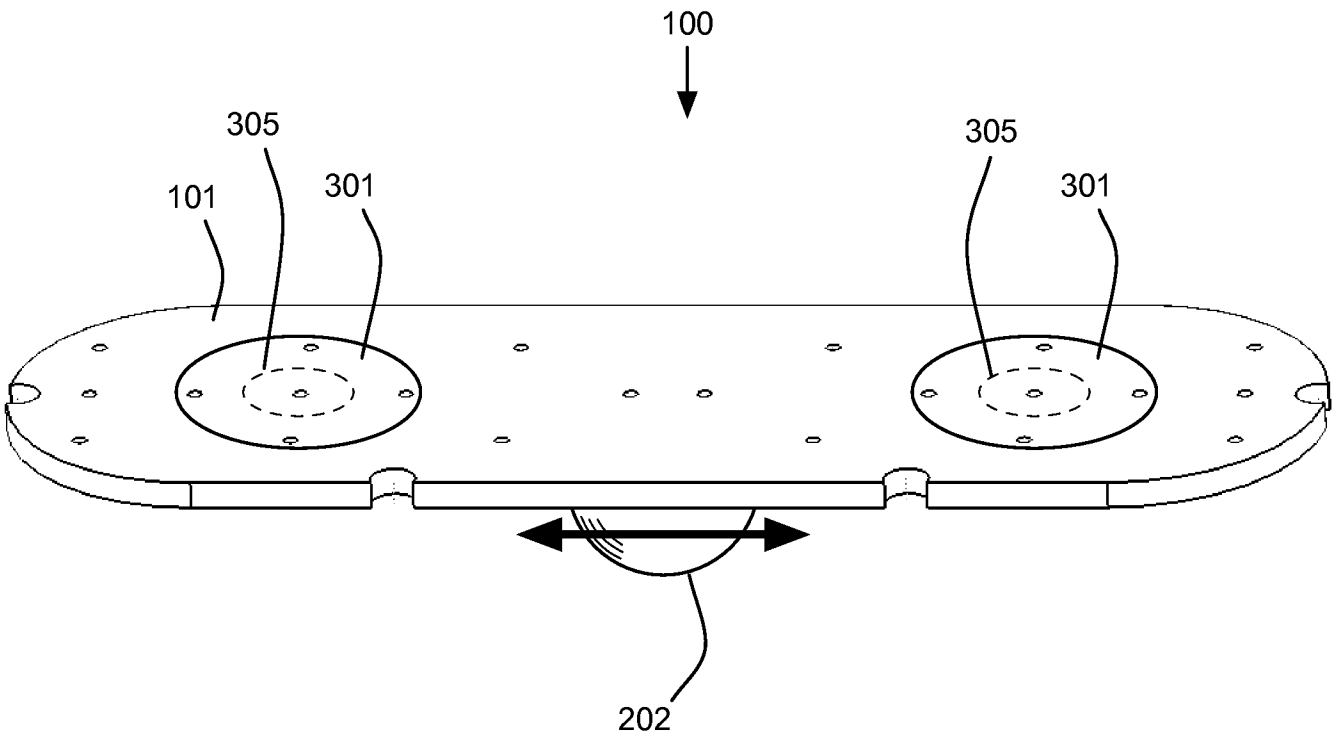
FIG. 3B illustrates a top perspective view of an embodiment of the invention with rotating elements on the top portion of the exercise interface.

FIG. 3B illustrates a top perspective view of an embodiment of the invention with rotating elements 301 on the top portion of the exercise interface. The elements may be implemented with or without ball bearings 305 under the rotating areas depending on the desired implementation. Rotating elements 301 enable push-ups with wrist rotation during the push-up for example. As shown, rotating elements rotate, but do not move with respect to the X or Y axes that define the width or height of the exercise interface respectively. In one or more embodiments of the invention, the rotating areas may move in one or two axes, i.e., with plates that fit into recessed pill shaped slots or areas that are wider and higher than the rotating elements, not shown for brevity. The rotating elements may optionally be utilized with or without handles for example.

Figure 4:
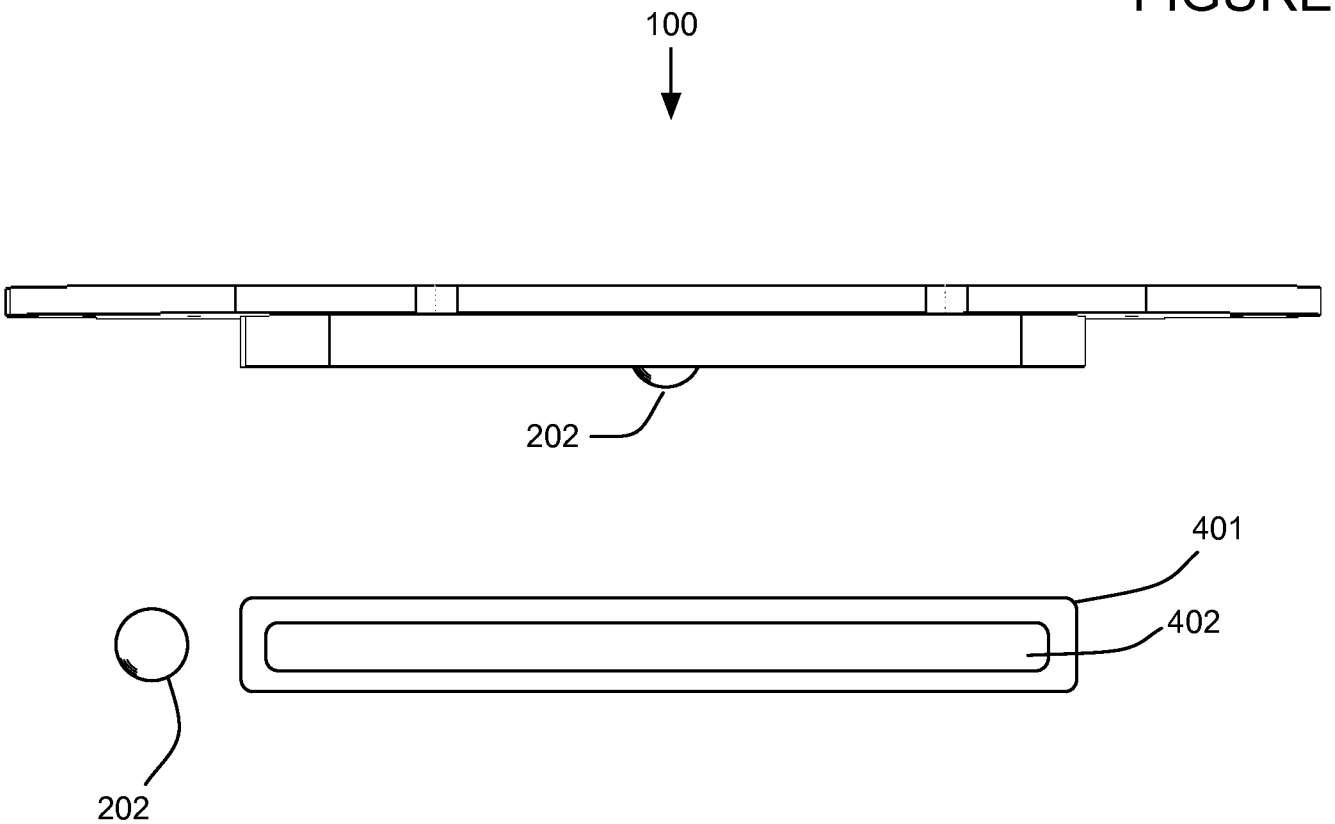
FIG. 4 illustrates a side view of an embodiment of the invention and a bottom view of an embodiment of a pivot space cover implemented with a slot having a gap width smaller than the diameter of the pivot element wherein the pivot space cover is configured to couple with the bottom portion of the pivot space and enable the pivot element to be held within the pivot space during use.

FIG. 4 illustrates a side view of an embodiment of the invention 100 and a bottom view of an embodiment of pivot space cover 401 implemented with slot 402 having a gap width smaller than the diameter of pivot element 202 wherein the pivot space cover is configured to couple with the bottom portion of the pivot space and enable the pivot element to be held within the pivot space during use.

Figure 5:
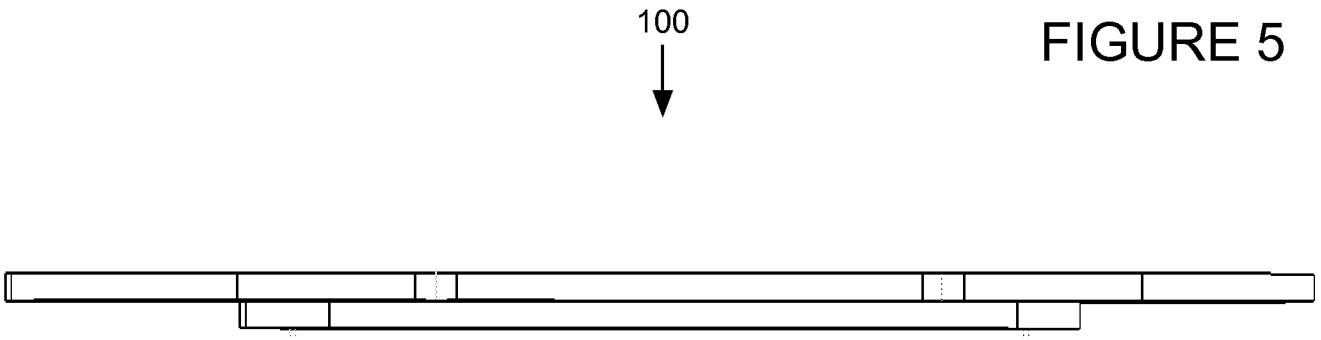
FIG. 5 illustrates a side view of an embodiment of the invention.

FIG. 5 illustrates a side view of an embodiment of the invention. Any desired material or dimension may be utilized in the construction of the apparatus so long as the apparatus can withstand the forces applied by the user or the weight of the user depending on the intended exercises to be performed by the user.

Figure 6:
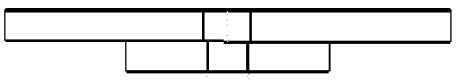
FIG. 6 illustrates a front view of an embodiment of the invention.

FIG. 6 illustrates a front view of an embodiment of the invention. The width of the pivot space and depth of the pivot space may vary depending on the desired dimensions of balance and the materials utilized in the construction of the apparatus.

One or more embodiments of the invention may utilize a handle on the top portion of the exercise interface. This enables a user to grab the handle instead of utilizing flat hands, for example when performing push-ups or handstands. In one or more embodiments, the handles may engage the exercise interface in fixed locations, for example with holes that engage pegs on each end of the handle. In other embodiments, the handles may rotate freely, i.e., engage the exercise interface on one side of the handle, or may utilize handles that rotate about the center of the handle, i.e., with a flat base coupled with the handle wherein the flat base includes a peg. In other embodiments of the invention, as shown in FIG. 3B, rotating areas, for example circles with rollers or ball bearings 305 beneath them may be utilized to provide locations on the exercise interface that rotate, for example for certain styles of push-ups that call for rotating hands during push-ups.

Figure 7A:
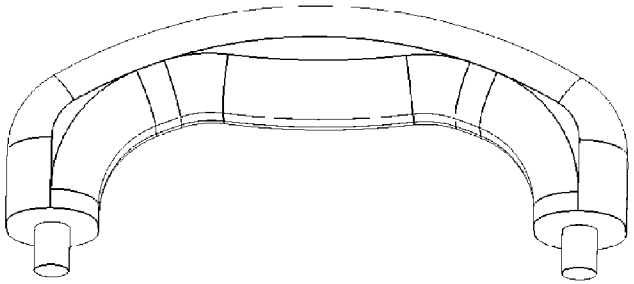
FIG. 7A illustrates a perspective view of an embodiment of a handle configured to engage a top portion of the exercise interface wherein the handle fixedly engages the exercise interface on both ends of the handle so as to disable rotation of the handle with respect to the exercise interface.

FIG. 7A illustrates a perspective view of an embodiment of a handle configured to engage a top portion of the exercise interface wherein the handle fixedly engages the exercise interface on both ends of the handle with two pegs as shown so as to disable rotation of the handle with respect to the exercise interface.

Figure 7B:
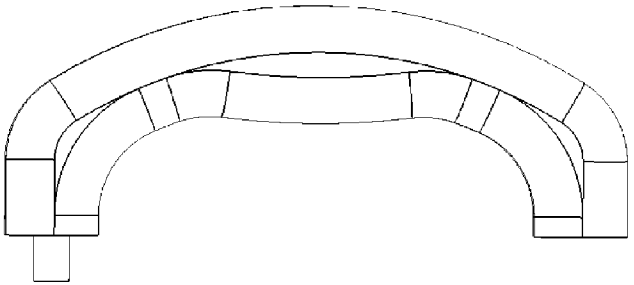
FIG. 7B illustrates a side view of an embodiment of a handle configured to engage a top portion of the exercise interface wherein the handle pivots near one end of the handle.

FIG. 7B illustrates a side view of an embodiment of a handle configured to engage a top portion of the exercise interface wherein the handle pivots near one end of the handle with a single peg as shown.

Figure 7C:
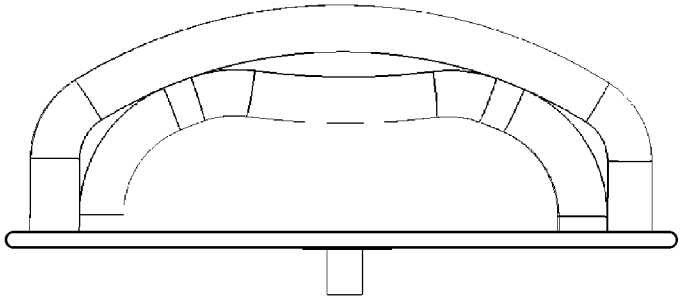
FIG. 7C illustrates a side view of an embodiment of a handle configured to engage a top portion of the exercise interface wherein the handle pivots near the middle of the handle.

FIG. 7C illustrates a side view of an embodiment of a handle configured to engage a top portion of the exercise interface wherein the handle pivots near the middle of the handle via a peg coupled with a plate or bar between the two ends of the handle for example.

Embodiments of the invention are also compact and may be easy carried or transported, for example in a suitcase for travel.

While the invention herein disclosed has been described by means of specific embodiments and applications thereof, numerous modifications and variations could be made thereto by those skilled in the art without departing from the scope of the invention set forth in the claims.

What is claimed is:

1. An exercise apparatus comprising:

an exercise interface comprising a top side and a bottom side, wherein said top side is configured to engage hands or feet of a user;

a pivot element;

a pivot space configured on said bottom side of said exercise interface, wherein said pivot space is configured to couple with said pivot element to enable said exercise device to pivot in at least one plane when said user performs a first exercise, and wherein said pivot element moves in relation to said pivot space and said exercise interface;

at least one extensible element configured to enable said user to perform a second exercise that is pull oriented, wherein said exercise interface is configured to engage said at least one extensible element; and, rotating elements on said top side of said exercise interface, wherein said rotating elements enable push-ups with arm rotation during said push-ups, and wherein said rotating elements com rise rollers or ball bearings beneath said rotating elements.

2. The apparatus of claim 1 wherein said pivot space is a slot with edges and wherein said pivot element is a ball and wherein said slot is configured to contain said ball when said ball rolls in said slot.

3. The apparatus of claim 1 wherein said pivot space is a two dimensional area and wherein said pivot element is a ball and wherein said two dimensional area is configured to contain said ball when said ball rolls in said two dimensional area.

4. The apparatus of claim 1 wherein said pivot space is a three dimensional area and wherein said pivot element is a ball and wherein said three dimensional area is configured to contain said ball when said ball rolls in said three dimensional area.

5. The apparatus of claim 1 wherein said pivot space is configured to enable said pivot element to freely disengage from said pivot space.

6. The apparatus of claim 1 wherein said pivot space is configured to disable said pivot element from disengaging said pivot space.

7. The apparatus of claim 1 wherein said exercise interface is substantially planar.

8. The apparatus of claim 1 further comprising at least one handle configured for said first exercise wherein said exercise interface is configured to engage said at least one handle.

9. The apparatus of claim 8 wherein said at least one handle pivots on one end of said at least one handle.

10. The apparatus of claim 8 wherein said at least one handle pivots at a middle portion of said at least one handle.

11. The apparatus of claim 8 wherein said at least one handle does not pivot.

12. The apparatus of claim 1 wherein said rotating elements are substantially planar.

13. The apparatus of claim 1 wherein said rotating elements each comprise a handle.

14. The apparatus of claim 1 wherein said at least one extensible element is configured to engage slots on an outer portion of said exercise interface.

15. The apparatus of claim 1 wherein said at least one extensible element is configured with two handles and is configured to wrap around said exercise interface.

16. An exercise apparatus comprising:

an exercise interface comprising a top side and a bottom side, wherein said top side is configured to engage hands or feet of a user and wherein said exercise interface is substantially planar;

a pivot element;

a pivot space configured on said bottom side of said exercise interface, wherein said pivot space is configured to couple with said pivot element to enable said exercise device to pivot in at least one plane when said user performs a first exercise, and wherein said pivot element moves in relation to said pivot space and said exercise interface;

wherein said pivot element is a ball and wherein said pivot space is configured to contain said ball when said ball rolls in said pivot space;

at least one extensible element configured to enable said user to perform a second exercise that is pull oriented, wherein said exercise interface is configured to engage said at least one extensible element;

at least one handle configured for said first exercise, wherein said exercise interface is configured to engage said at least one handle; and, rotating elements on said top side of said exercise interface, wherein said rotating elements enable push-ups with arm rotation during said push-ups, and wherein said rotating elements comprise rollers or ball bearings beneath said rotating elements.

* * * * *